US011111125B2

(12) United States Patent
Rittenburg et al.

(10) Patent No.: US 11,111,125 B2
(45) Date of Patent: Sep. 7, 2021

(54) EFFERVESCENT LIQUID DISPENSER

(71) Applicant: MIDNIGHT MADNESS DISTILLING, LLC, Trumbauersville, PA (US)

(72) Inventors: Angus Rittenburg, Perkasie, PA (US); Casey Parzych, Trumbauersville, PA (US)

(73) Assignee: MIDNIGHT MADNESS DISTILLING, LLC, Trumbauersville, PA (US)

( * ) Notice: Subject to any disclaimer, the term of this patent is extended or adjusted under 35 U.S.C. 154(b) by 0 days.

(21) Appl. No.: 16/620,368

(22) PCT Filed: Jul. 20, 2018

(86) PCT No.: PCT/US2018/043088

§ 371 (c)(1),
(2) Date: Dec. 6, 2019

(87) PCT Pub. No.: WO2019/023059

PCT Pub. Date: Jan. 31, 2019

(65) Prior Publication Data

US 2020/0148526 A1 May 14, 2020

Related U.S. Application Data

(60) Provisional application No. 62/609,804, filed on Dec. 22, 2017, provisional application No. 62/536,772, filed on Jul. 25, 2017.

(51) Int. Cl.
*B67D 1/04* (2006.01)
*B67D 1/12* (2006.01)
(Continued)

(52) U.S. Cl.
CPC ..... *B67D 1/0412* (2013.01); *B67C 3/065* (2013.01); *B67D 1/0456* (2013.01); *B67D 1/125* (2013.01);
(Continued)

(58) Field of Classification Search
CPC .... B67D 1/0412; B67D 1/0456; B67D 1/125; B67D 1/1252; B67D 2001/0093;
(Continued)

(56) References Cited

U.S. PATENT DOCUMENTS 650,413 A * 5/1900 O'Neill ..... B67D 1/0456
1,412,321 A * 4/1922 Tate ..... B67D 1/0412 222/399
(Continued)

FOREIGN PATENT DOCUMENTS

AU 2011275873 B2 1/2012
DE 19805198 A1 8/1999
(Continued)

OTHER PUBLICATIONS

Carbacap Carbination System, Carba Cap, carbacap.com, Sep. 10, 2015.
Innovation, Growler Werks, growlerwerks.com, Apr. 2, 2016.

*Primary Examiner* — Timothy P. Kelly
*Assistant Examiner* — Stephanie A Shrieves
(74) *Attorney, Agent, or Firm* — McNees Wallace & Nurick LLC

(57) ABSTRACT

An effervescent liquid dispenser for a carbonated beverage is disclosed that includes a container containing liquid to be dispensed receiving pressurized gas from a pressurized gas source, becoming a pressurized liquid, the pressurized liquid becoming an effervescent liquid upon being dispensed from the container; and a dispense valve that is positionable in a first position for permitting pressurized gas to be received in
(Continued)

a vessel to become the pressurized gas source, the dispense valve selectably movable between the first position and a second position, the dispense valve being secured to the container in the second position in response to the vessel receiving pressurized gas, the vessel becoming the pressurized gas source for the dispenser; wherein the container complies with 27 C.F.R. 5.46 (1999) and conforms with 49 C.F.R. 173.306 (1976).

21 Claims, 11 Drawing Sheets

(51) Int. Cl.
*B67C 3/06* (2006.01)
*B67D 1/00* (2006.01)

(52) U.S. Cl.
CPC .... *B67D 1/1252* (2013.01); *B67D 2001/0093* (2013.01)

(58) Field of Classification Search
CPC ..... B67D 1/0884; B67D 1/04; B67D 1/12; B67D 1/0418; B67D 1/0406; B65B 3/00; B67C 3/06; B67C 3/065; B67C 3/10; B67C 3/18; B67C 3/04; B67C 3/22
USPC ..... 141/25, 14–17
See application file for complete search history.

(56) References Cited

U.S. PATENT DOCUMENTS 1,648,575 A * 11/1927 Campbell ..... B67D 1/0456 141/197
2,189,643 A * 2/1940 Ward ..... B67D 1/0412 141/17
2,199,661 A 5/1940 Gamble et al.
2,345,081 A * 3/1944 Ward ..... B67D 1/0456 141/15
2,606,749 A 8/1952 Bayers, Jr.
2,705,578 A 4/1955 Burns
2,822,002 A * 2/1958 Mack ..... B05B 9/0833 141/17
3,161,327 A * 12/1964 Kraus ..... B67D 1/0412 222/204
3,217,947 A 11/1965 Bauerlein
3,556,356 A * 1/1971 Mockesch ..... B67D 1/0412 222/399
4,171,004 A 10/1979 Cerrato et al.
4,265,374 A 5/1981 Sebalos
4,363,424 A 12/1982 Holben et al.
4,408,701 A * 10/1983 Jeans ..... B67D 1/0021 222/185.1
4,479,520 A 10/1984 Holben
4,694,975 A * 9/1987 Hagan ..... B67D 1/0456 215/4
4,754,897 A 7/1988 Bruce
4,867,209 A * 9/1989 Santoiemmo ..... B01F 3/04801 141/19
5,021,219 A 6/1991 Rudick et al.
5,022,565 A * 6/1991 Sturman ..... B67D 1/0418 222/396
5,110,012 A 5/1992 Scholle et al.
5,199,609 A 4/1993 Ash, Jr.
5,443,186 A * 8/1995 Grill ..... B67D 1/0418 222/396
5,538,028 A 7/1996 Lombardo
5,549,037 A 8/1996 Stumphauzer et al.
6,021,922 A 2/2000 Bilskie et al.
6,036,054 A 3/2000 Grill
6,073,811 A 6/2000 Costea
6,216,913 B1 4/2001 Bilskie et al.
6,276,565 B1 8/2001 Parsons et al.
6,311,875 B1 11/2001 Anderson et al.
6,360,923 B1 3/2002 Vlooswijk
6,386,403 B2 5/2002 Parsons et al.
6,412,668 B1 7/2002 Vlooswijk et al.
6,415,963 B1 7/2002 Vlooswijk et al.
6,439,549 B1 8/2002 Loov
6,530,400 B2 3/2003 Nelson
6,745,922 B1 6/2004 Vlooswijk et al.
7,083,071 B1 8/2006 Crisp et al.
7,584,873 B2 9/2009 Grittmann
7,845,522 B2 12/2010 Grill
7,984,845 B2 7/2011 Kelly
8,038,039 B2 10/2011 Kelly et al.
8,052,012 B2 11/2011 Kelly et al.
8,066,156 B2 11/2011 Schiff et al.
8,141,755 B2 3/2012 Kelly et al.
8,177,103 B2 5/2012 Pakkert et al.
8,191,470 B2 6/2012 Hoss et al.
8,302,822 B2 11/2012 Kranz et al.
8,684,240 B2 4/2014 Sauer et al.
8,757,439 B2 6/2014 Kambouris
8,763,866 B2 7/2014 Oberhofer et al.
8,808,775 B2 8/2014 Novak et al.
8,915,263 B2 12/2014 Haines et al.
9,114,971 B2 8/2015 Rassmussen et al.
9,227,827 B1 1/2016 Scott
9,248,416 B2 2/2016 Striebinger
9,272,893 B2 3/2016 Jacobs
9,289,731 B2 3/2016 Tatera
9,352,949 B2 5/2016 Rege et al.
9,409,759 B2 8/2016 Wilder et al.
9,427,712 B2 8/2016 Ring et al.
2008/0217361 A1* 9/2008 Vitantonio ..... B67D 1/1252 222/399
2008/0258099 A1 10/2008 Hawkins
2011/0017770 A1 1/2011 Maas et al.
2011/0210141 A1* 9/2011 Maas ..... B67D 1/0834 222/1
2013/0233878 A1* 9/2013 Lindmayer ..... B67D 1/1202 222/1
2016/0083239 A1 3/2016 Rasmussen et al.
2016/0159556 A1 6/2016 Brouwer et al.
2016/0251210 A1 9/2016 Hill et al.
2016/0251212 A1 9/2016 Rege et al.
2017/0174494 A1* 6/2017 Landman ..... B67D 1/0418

FOREIGN PATENT DOCUMENTS

DE 602005004445 T2 1/2009
DE 10066425 B4 3/2011
DE 102010012175 A1 9/2011
EP 0063155 A1 10/1982
EP 0080358 A1 6/1983
EP 0234797 A1 9/1987
EP 0291788 A1 11/1988
EP 0372569 A2 6/1990
EP 0525833 A2 2/1993
EP 0636407 A1 2/1995
EP 1096873 A1 5/2001
EP 1140657 A1 10/2001
EP 1140658 A1 10/2001
EP 1140692 A1 10/2001
EP 1037850 B1 4/2002
EP 2178772 A1 4/2010
EP 1888450 B1 11/2012
EP 2129596 B1 5/2013
EP 2001790 B1 5/2015
EP 2861521 B1 11/2015
FR 528387 A 11/1921
GB 2421493 A 6/2006
JP 2002037394 A1 2/2002
JP 2006008249 A 1/2006
JP 5308066 B2 7/2013
JP 5649801 B2 11/2014
KR 101387015 B1 4/2014
NL 1032890 C2 5/2008
RU 2362728 C2 7/2009
WO 9954252 A1 10/1999
WO 2009137877 A1 11/2009

(56) References Cited

FOREIGN PATENT DOCUMENTS

| | | | |
|---|---|---|---|
| WO | 2011051740 | A2 | 5/2011 |
| WO | 2011073702 | A1 | 6/2011 |
| WO | 2011152717 | A1 | 12/2011 |
| WO | 2012156709 | A2 | 11/2012 |
| WO | 2014161985 | A1 | 10/2014 |
| WO | 2015119497 | A1 | 8/2015 |
| WO | 2015147636 | A1 | 10/2015 |
| WO | 2016069066 | A1 | 5/2016 |
| WO | 2018125803 | A1 | 7/2018 |
| ZA | 201101530 | B | 8/2013 |

* cited by examiner

EFFERVESCENT LIQUID DISPENSER

FIELD OF THE INVENTION

The present invention is directed to the field of liquid dispensers, and in particular, to effervescent liquid dispensers.

BACKGROUND OF THE INVENTION

Dispensers for dispensing effervescent liquids subject a liquid to a pressurized gas, such as carbon dioxide, a portion of which pressurized gas dissolves in the liquid. Upon dispensing the liquid from the dispenser into an environment having a lower pressure and/or a lower temperature, the pressurized gas begins escaping from the liquid in the form of bubbles. This is known as effervescence. Such dispensers typically have a container containing liquid, the container receiving pressurized gas from a pressurized gas source. The pressurized gas source is then isolated from the container. The pressurized gas not only brings about effervescence, but provides the impetus for dispensing the liquid from the container.

This conventional dispenser arrangement has several shortcomings. For example, as the liquid is dispensed, the gas pressure in the container is reduced, and the degree of effervescence may likewise be reduced. Furthermore, in an effort to maintain a high degree of effervescence for the liquid irrespective of the amount of liquid remaining in the container, additional pressurized gas may need to be initially introduced into the container. Such additional pressurized gas increases the gas pressure inside the container, which raises safety concerns.

There are several federal regulations which relate to packaging in the liquor industry. For example, current federal regulation (27 C.F.R. § 5.46 (2017) provides, absent special exceptions, that for liquor bottles having a capacity of 200 mL or more, the headspace cannot exceed 8 percent of the total capacity of the bottle after closure. In order for conventional dispenser arrangements to comply with such regulations (e.g., to dispense the contents of a container with 8 percent or less headspace), would require a headspace pressure of over 300 psi. Glass containers capable of withstanding such a pressure are impractical and unsafe.

Examples of conventional dispensing arrangements are disclosed in U.S. Pat. Nos. 90,215; 2,098,169; 6,415,963; 6,745,922; 8,177,103; 8,191,740; 8,302,822; 9,352,949; U.S. Publication Nos. 2016/0251210 and 2016/0251212; EP 2129596; WO 00/35774 and WO 00/35803. The disclosure of the foregoing patents and patent applications is hereby incorporated by reference.

There is a need in the art for effervescent liquid dispensers that do not suffer from these shortcomings.

SUMMARY OF THE INVENTION

The instant invention solves problems associated with conventional dispensing arrangements by providing a safe (e.g., having a reduced risk of rupture or container failure), carbonated liquid dispensing device that employs a disposable container and a permanently affixed closure that maintains carbonation and allows for dispensing of the contents without decreased carbonation. This in turn allows for a consumer product that mimics the behavior of the conventional seltzer siphon such as the one referenced in U.S. 90,215 with added safety and dispensing consistency. Conventional seltzer siphons were partially filled leaving an excess of 25% of the entire volume of the container with a head space containing a pressurized gas between 60 and 120 psi. Such pressures are undesirable when using glass containers or other containers that may fail catastrophically, and are avoided by the instant invention. In addition, as the contents of the conventional seltzer siphon were dispensed, the pressure in the head space decreases, thus gas dissolved in the fluid is released thereby decreasing overall effervescence. Another variation on the conventional seltzer siphon disclosed, for example, in U.S. Pat. No. 2,098,169A, which requires the user to acquire and insert a pressurized cartridge and, thereafter, replace a spent cartridge. Such replaceable pressurized cartridges are not required by the instant invention.

One embodiment of the instant invention relates to a disposable (i.e., not refillable or reusable) alcoholic beverage packaging that can maintain carbonation and self-dispense a carbonated beverage while being compliant with the headspace requirements of 27 C.F.R. § 5.46 (2017) (www.gpo.gov/fdsys/pkg/CFR-2017-title27-vol1/pdf/CFR-2017-title27-vol1-part5.pdf), which provides, absent special exceptions, that for liquor bottles having a capacity of 200 mL or more, the headspace cannot exceed 8 percent of the total capacity of the bottle after closure. In addition, when charged with a division 2.2 gas, such as carbon dioxide (UN 1013), which is a non-flammable, nonpoisonous compressed gas, the instant invention's design meets the limited quantities exemption set forth in 49 C.F.R. § 173.306 (2017) (www.gpo.gov/fdsys/pkg/CFR-2017-title49-vol2/pdf/CFR-2017-title49-vol2-part173.pdf), pursuant to 49 C.F.R. § 173.306(a)(1) & (i) (i.e., not more than 4 fluid ounces capacity for carbon dioxide), which in turn exempts the invention from various shipping requirements under United States law. This aspect of the design is consistent with the limited quantities exemption recognized internationally pursuant to § 1.1.1.5 and Chapter 3.4 of the United Nations Recommendations on the Transport of Dangerous Goods—Model Regulations (Rev. 20, 2017) (www.unece.org/trans/danger/publi/unrec/rev20/20files_e.html) (carbon dioxide quantity limit for inner packaging or article of 120 mL). All of the above regulations are incorporated by reference.

One embodiment of the present invention is directed to an effervescent liquid dispenser including: a container containing liquid to be dispensed receiving pressurized gas from a pressurized gas source, becoming a pressurized liquid, the pressurized liquid becoming an effervescent liquid upon being dispensed from the container; and a dispense valve that is positionable in a first position for permitting pressurized gas to be received in a vessel to become the pressurized gas source, the dispense valve selectably movable between the first position and a second position, the dispense valve being secured to the container in the second position in response to the vessel receiving pressurized gas, the vessel becoming the pressurized gas source for the dispenser.

One embodiment of the present invention is directed to an effervescent liquid dispenser including: a container containing liquid to be dispensed receiving pressurized gas from a pressurized gas source, becoming a pressurized liquid, the pressurized liquid becoming an effervescent liquid upon being dispensed from the container; and a dispense valve that is positionable in a first position for permitting pressurized gas to be received in a vessel to become the pressurized gas source, the dispense valve selectably movable between the first position and a second position, the dispense valve being secured to the container in the second position in response to the vessel receiving pressurized gas, the vessel becoming the pressurized gas source for the dispenser; and in which the liquid dispenser is permanently affixed to the container and the container is non-refillable. One embodiment of the invention relates to any of the foregoing embodiments in which the pressurized gas source is located within the container.

One embodiment of the invention relates to any of the foregoing embodiments in which the effervescent liquid includes a carbonated alcoholic beverage.

One embodiment of the invention relates to any of the foregoing embodiments in which the container complies with 27 C.F.R. 5.46 (2017).

One embodiment of the invention relates to any of the foregoing embodiments in which the container conforms with 49 C.F.R. 173.306 (2017).

One embodiment of the invention relates to any of the foregoing embodiments in which the liquid dispenser is permanently affixed by a "snap-fit" connection. That is, the liquid dispenser is affixed to the container by applying a downward force that causes the liquid dispenser to engage the open end of the container wherein protuberances on the liquid dispenser are compressed as the protuberances engage an edge or a surface on the container and travel past the edge in order to return to an uncompressed position thereby locking the liquid dispenser to the container.

One embodiment of the invention relates to any of the foregoing embodiments in which the liquid dispenser is permanently affixed by a crimp fit.

One embodiment of the invention relates to any of the foregoing embodiments in which the pressurized gas source is connected to the regulator.

One embodiment of the invention relates to any of the foregoing embodiments in which a shaft extends through the dispenser and movement of the shaft permits pressurized gas from the pressurized gas source to flow which forces an effervescent liquid into a passageway that in turn permits the effervescent liquid to pass through the dispenser and be dispensed from the container.

One embodiment of the invention relates to any of the foregoing embodiments further including a tap that is located externally to the dispenser and container and in which movement of the shaft is caused by rotational movement of a tap.

One embodiment of the invention relates to any of the foregoing embodiments further including a spout connected to the dispenser and in which the effervescent liquid is dispensed from the container from the spout.

The aspects and embodiments of the invention can be used alone or in combinations with each other.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 3:
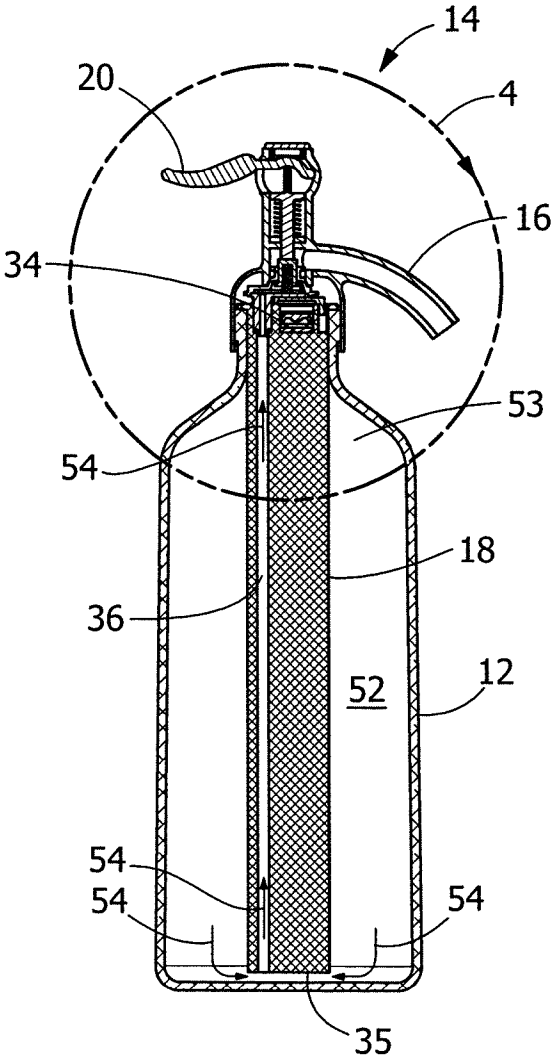
FIG. 3 is a cross-section of the dispenser taken along line 3-3 of FIG. 2.

This invention provides an apparatus or a means, such as a dispenser, for dispensing a liquid as well as maintaining a uniform level of effervescence using a pressurized gas. This instant invention provides a means for fully dispensing an effervescent fluid from a container without requiring high pressurization of the container itself. Unlike existing dispensers, the inventive dispenser is suitable for scale consumer products because it can be packaged using components having relatively small form factors, manufactured in large quantities, and made at low costs. The device includes a pressure vessel or a vessel or high-pressure gas source for storing high-pressure gas, a regulator for maintaining low pressure inside the container, and a device, feature or means to relieve pressure to ensure container pressure remains below a preselected threshold. One example of a means to relieve pressure comprises a relief valve. The high-pressure gas source can be located internally or externally of the container. As just one example, existing alcoholic beverage packaging could be made safer by this invention without exceeding the headspace limitation imposed by law (e.g., the inventive dispenser is self-dispensing while employing a relatively low pressure within the container). Utilizing the novel dispenser of the present invention ensures the containers comply with current federal regulations, such as (49 C.F.R. § 173.306 (2017)) and (27 C.F.R. § 5.46 (2017)), while reducing the pressure level of pressurized gas in the container, while providing a container having improved safety in comparison to conventional dispensers. More specifically, 27 C.F.R. § 5.46 (2017) provides, absent special exceptions, that for liquor bottles having a capacity of 200 mL or more, the headspace cannot exceed 8 percent of the total capacity of the bottle after closure. In addition, when charged with a division 2.2 gas, such as carbon dioxide, which is a non-flammable, nonpoisonous compressed gas, the instant invention's design meets the requirements set forth in 49 C.F.R. § 173.306 (2017), such as 49 C.F.R. § 173.306 (a) (1) which grants it the limited quantity exemptions of 49 C.F.R. § 173.306(i) which in turn exempts the invention from various shipping requirements nationally and internationally. In particular, the instant invention permits substantially completely dispensing a carbonated beverage wherein the pressure within the container is less than 60 psi, for example, typically about 25 to about 40 psi, about 20 to about 30 psi and normally about 25 to about 30 psi.

The invention also provides a container having an effervescent fluid therein and having the dispenser permanently affixed to the container (e.g., an effervescent fluid is introduced into the container and sealed therein until it is desired to dispense the effervescent fluid from the container). The invention further provides a method for dispensing the entire contents of an effervescent fluid from a container under generally uniform pressure.

For purposes herein, "effervescent fluid" or "effervescent liquid" in accordance with the instant invention includes a fluid that becomes effervescent by being released from the inventive dispenser as well as a fluid that is carbonated prior to introduction into the dispenser. Examples of such fluids include carbonated or effervescent ales, colas, fruit drinks, teas, waters, sodas, soft drinks, among other beverages as well as alcoholic beverages such as gin, liqueurs, vodka, rum, champagne, sparkling wine, among other alcoholic beverages. While any suitable degree of effervescence or carbonation can be employed, the fluid can comprise about 1 to about 10 volumes, about 2 to about 8 volumes and normally about 2 to 3 volumes of gas.

The instant invention further provides for a method for introducing an effervescent liquid into the container.

The instant invention further provides a method for dispensing an effervescent fluid from the container.

For purposes herein, headspace, such as headspace 53 shown in FIG. 3, is defined as the distance from the top of the container to the top of a product, which in this case is to the top of pressurized liquid 52.

Figure 2:
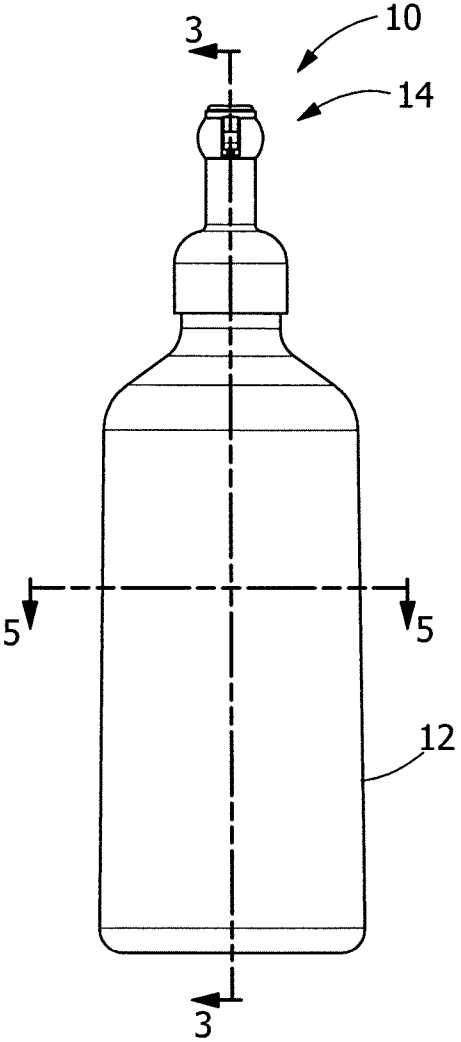
FIG. 2 is a rotated rear elevation view of the dispenser of FIG. 1.
Figure 1:
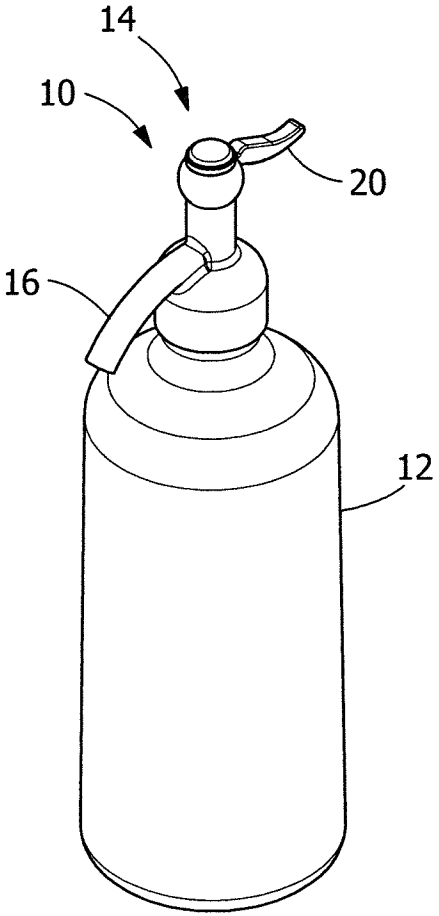
FIG. 1 is an upper front perspective view of an exemplary dispenser.

FIGS. 1 and 2 show one embodiment of an exemplary dispenser 10 including a container 12 that is secured to a dispenser assembly 14. Dispenser assembly 14 includes a high-pressure vessel or pressure vessel or vessel or high-pressure source or pressurized gas source 18 (FIG. 3) that provides pressurized gas, such as carbon dioxide, nitrogen, among others, to a liquid contained in container 12, which liquid is or becomes a pressurized liquid 52 (FIG. 3). A portion of the pressurized gas can dissolve in pressurized liquid 52 such that upon the pressurized liquid 52 being discharged from a spout 16 into an ambient environment 19 (FIG. 4) surrounding the dispenser, pressurized liquid 52 becomes effervescent liquid 56. When a previously carbonated effervescent fluid is to be dispensed, the pressurized gas maintains a pressure upon the effervescent fluid thereby maintaining the effervescence and permitting the effervescent fluid to be dispensed at a generally uniform pressure.

It is to be understood that any suitable high-pressure gas that promotes or maintains effervescence may be used.

Figure 4:
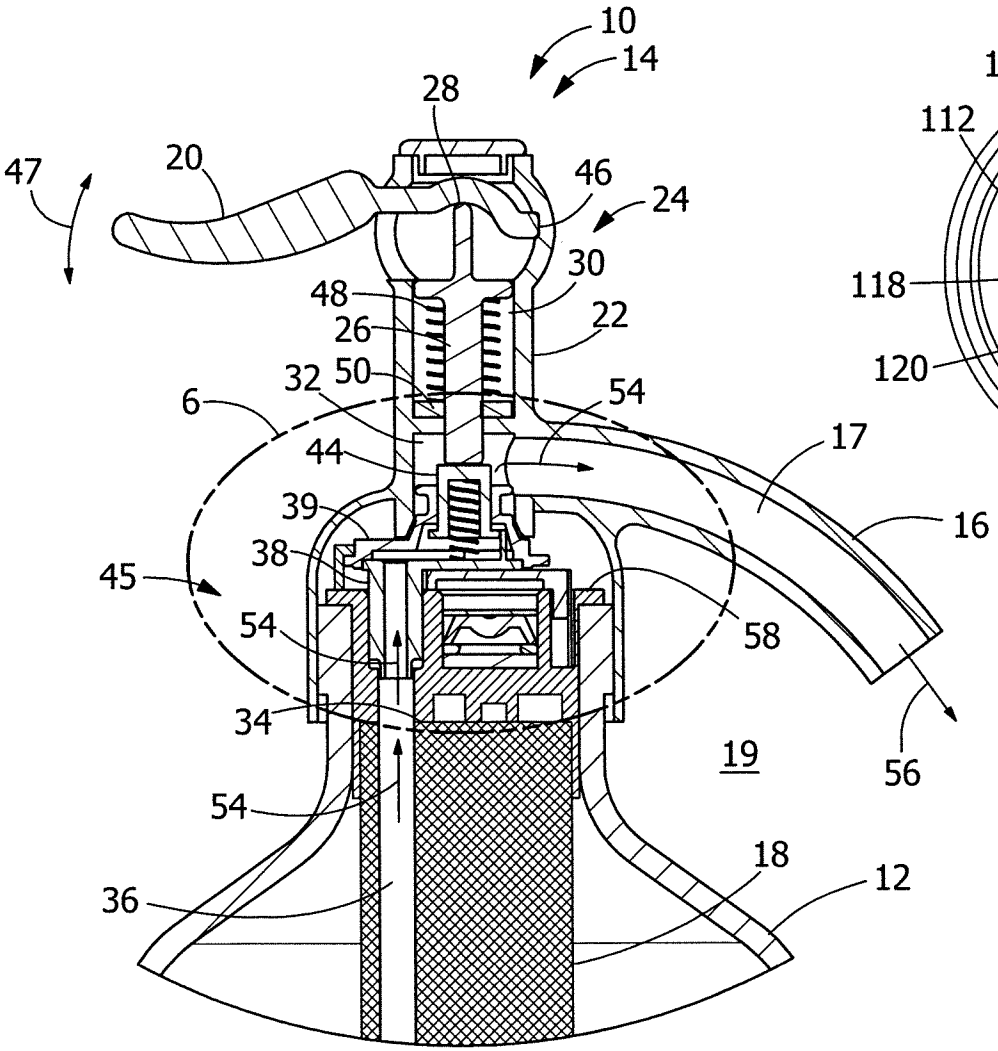
FIG. 4 is a further enlarged, partial cross-section taken from region 4 of the dispenser of FIG. 3.
Figure 6:
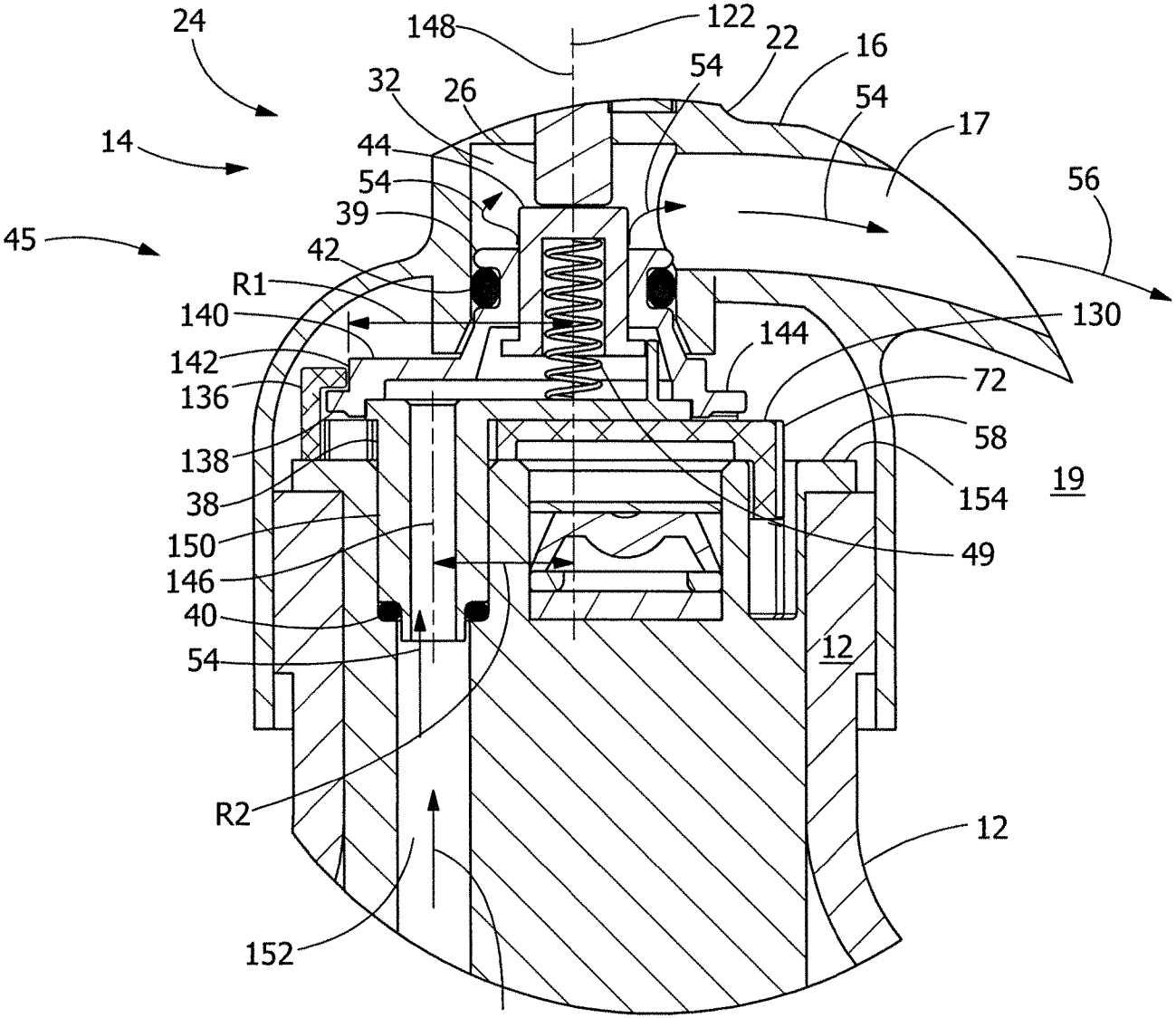
FIG. 6 is a further enlarged, partial cross-section taken from region 6 of the dispenser of FIG. 4.

As shown in FIGS. 3, 4 and 6, the dispenser assembly 14 includes a dispensing mechanism 24 including dispenser bodies 22, 58. A proximal end 34 (FIG. 4) of pressurized gas source 18 is secured to a dispenser body 58 that is secured to container 12. As shown, pressurized gas source 18 comprises a passageway 36 that extends from a distal end 35 positioned near the bottom of container 12 to proximal end 34 for selectively forcibly directing a pressurized liquid flow 54 of pressurized liquid 52 therealong from container 12. An O-ring 40 promotes a fluid tight seal between a valve support member 38 and dispenser body 58 that are axially aligned with passageway 36. A cap or cap member 39 slidably secures valve member 44. A dispense valve 45 includes at least valve support member 38, cap member 39, and the valve member 44. Pressurized liquid flow 54 of pressurized liquid 52 from passageway 36 continues through dispenser body 58, then between cap member 39 and valve member 44 through dispenser body 22 before being discharged from spout 16. In one embodiment, dispenser assembly 14 is permanently affixed to container 12 by any suitable means such as press-fit, crimp, rolled flange, retaining rings and snaps, or one-way threaded engagement, such as damaging or causing the mating threads to seize upon sufficient engagement such that the threads are rendered unusable to permit threaded disassembly, among other permanent attachment means and methods. In particular, since the dispenser assembly 14 is permanently affixed to container 12, container 12 is intended to be discarded, recycled or otherwise disposed of after dispensing the effervescent liquid is complete.

Figure 5:
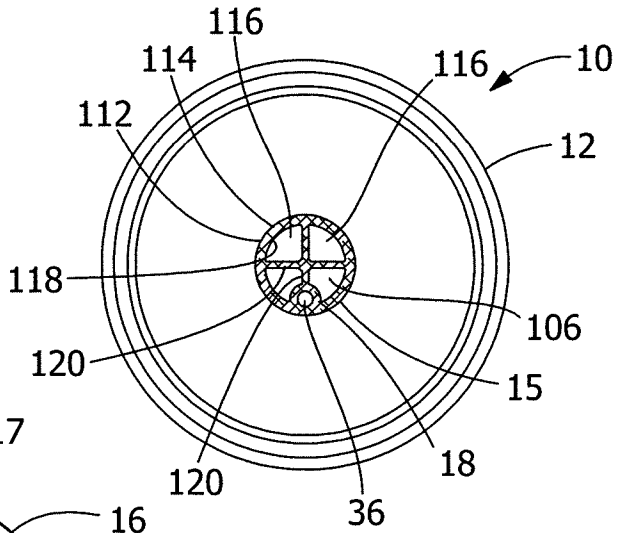
FIG. 5 is a cross-section of the dispenser taken along line 5-5 of FIG. 2.

FIG. 5 is a cross-section of dispenser 10 (and pressurized gas source 18) taken along line 5-5 of FIG. 2, which line 5-5 being transverse to the axial length of the dispenser. For purposes of distinction and clarity, FIG. 3 is a cross-section of dispenser 10 (and pressurized gas source 18) taken along line 3-3 of FIG. 2, which line 3-3 being parallel to the axial length of the dispenser. As further shown in FIG. 5, pressurized gas source 18 is centered relative to container 12. In one embodiment, pressurized gas source 18 may be non-centered relative to container 12. Pressurized gas source 18 comprises an enclosure 112 having an outer surface 114 and further including a hollow volume or cavity 116 having an inner surface 118. One or more ribs 120 extend between opposed portions of inner surface 118 for purposes of reducing stresses associated with filling cavity 116 with pressurized gas 106. In one embodiment, one or more ribs 120 may continuously extend between opposed portions of inner surface 118, forming separate cavities 116, so long as cavities 116 are in mutual fluid communication with each other. In one embodiment, the vessel or enclosure 112 may be an extrusion.

As further shown in FIGS. 4 and 6, a lever or tap 20 (FIG. 4) rotates in a rotational movement 47 about a pivot 46 formed in dispenser body 22. Tap 20 abuts a head 28 of a fluid shaft 26, which head 28 is positioned in a passageway 30 of dispenser body 22. Head 28 extends to fluid shaft 26. Fluid shaft 26 passes through a fluid tight opening formed in a fluid shaft seal 50 and extends through a passageway 32 formed in dispenser body 22, abutting a plug or valve member 44 slidably secured in cap member 39. O-ring 42 provides a fluid tight seal between cap member 39 and dispenser body 22 as shown in FIG. 6.

As further shown in FIG. 4, a spring 48 is positioned between fluid shaft seal 50 and head 28 of fluid shaft 26. By virtue of spring 48, head 28 biases and urges tap 20 in rotational movement 47 away from pressurized gas source 18, and permitting spring 49 (FIG. 6) to urge valve member 44 into its closed position in contact with cap member 39.

As shown in FIGS. 4 and 6, in order to dispense pressurized fluid 52 (FIG. 3), a sufficient force is applied to tap 20 in rotational movement 47 toward pressurized gas source 18 to overcome the opposing force generated by spring 48. When the opposing force generated by spring 48 is overcome, fluid shaft 26 is urged into abutting contact with valve member 44, similarly urging valve member 44 to an open position. With valve member 44 in an open position, pressurized liquid 52 (FIG. 3) which is pressurized to a higher pressure than the environmental or ambient environment 19 is urged into pressurized liquid flow 54 through passageway 36, then through cap member 39, then between cap member 39 and valve member 44, then through passageway 32 and finally through passageway 17, whereupon the pressurized liquid 52 is discharged into ambient environment 19. Upon being discharged into ambient environment 19, pressurized liquid 52 becomes effervescent liquid 56, due to effervescence occurring as a result of the reduction of pressure level in the ambient environment 19 compared to the pressure level in container 12. In the event the pressurized liquid 52 comprises a previously carbonated effervescent liquid, then the effervescent liquid 56 has a degree of carbonation substantially the same as when the carbonated liquid was introduced into container 12. In one embodiment, carbonated liquid is introduced into container 12 prior to installing dispense valve 45.

Figure 9:
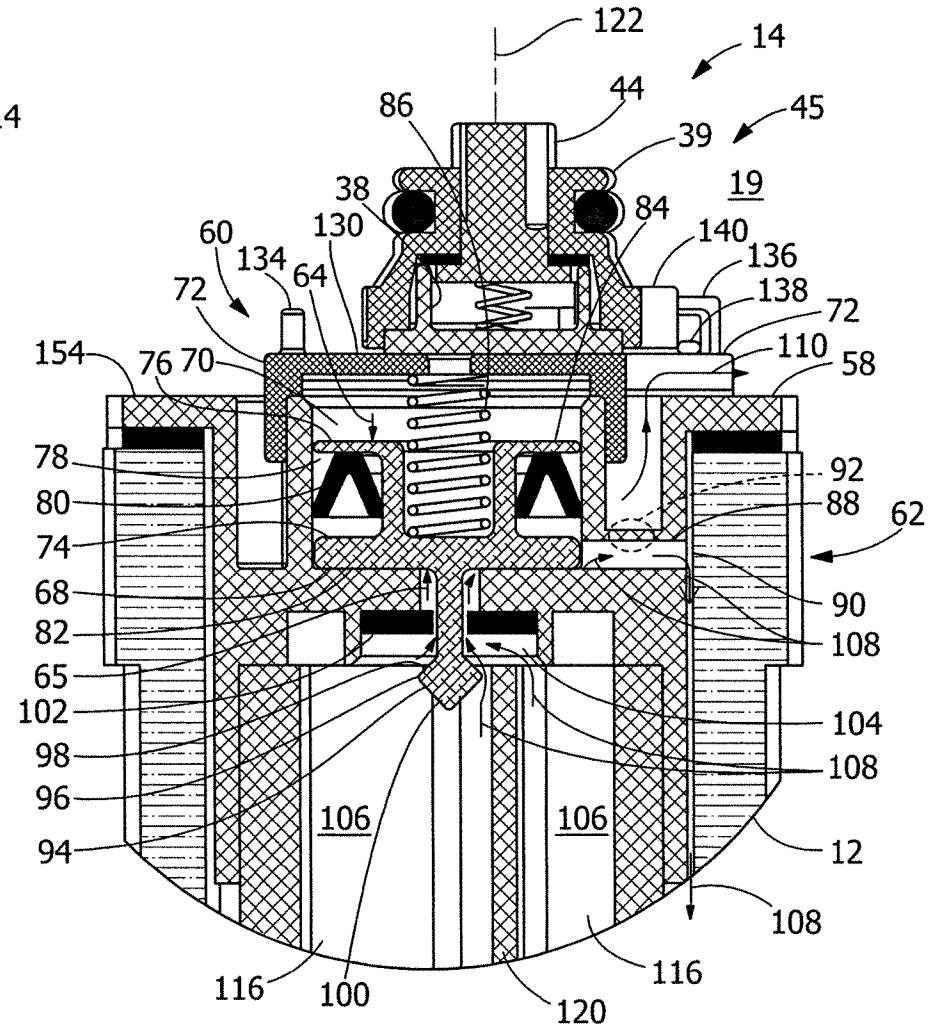
FIG. 9 is a further enlarged, partial cross-section taken along line 9-9 of the partial dispenser of FIG. 8.
Figure 8:
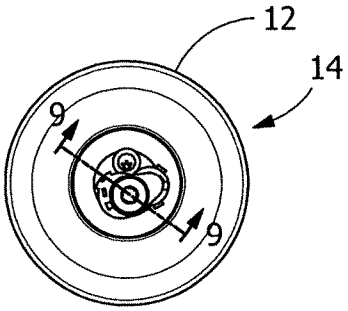
FIG. 8 is a plan view of the partial dispenser of FIG. 7.
Figure 7:
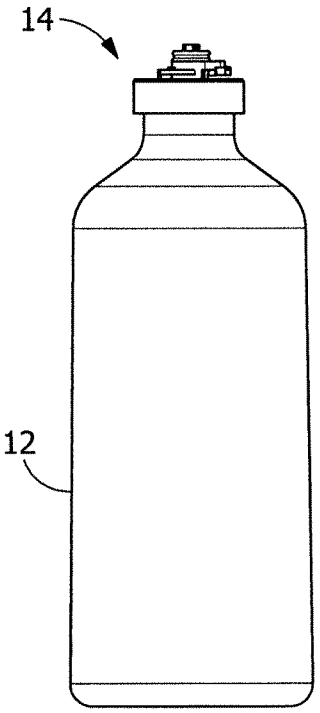
FIG. 7 is an elevation view of an exemplary partial dispenser.

As shown in FIGS. 7-9, the dispenser includes a regulator 60 and an optional pressure relief mechanism 62 incorporated into dispenser assembly 14. For purposes herein, dispenser assembly 14 may include container 12. FIG. 7 is an elevation view of dispenser assembly 14. FIG. 8 is a plan view of the dispenser assembly 14 of FIG. 7. FIG. 9 is a further enlarged, partial cross-section taken along line 9-9 of the dispenser assembly 14 of FIG. 8.

As further shown in FIG. 9, a pressure regulator or regulator 60 includes a valve member 68 that is inserted inside of a passageway 70 formed between a cap or cap member 72 and dispenser body 58. Valve member 68 includes annular flanges 74, 76 separated by an annular recess 78 for receiving a seal 80 such as a U-cup seal. Annular flange 74 includes a surface or side 82 in selective fluid communication with pressurized gas source 18, and with container 12 via passageways 88, 90. At least a portion 92 of passageway 88 may operate as a pressure relief mechanism 62, as will be discussed in further detail below. Annular flange 76 includes a surface or side 84. A spring 86 is positioned in a passageway 70 between side 84 and an inner surface of cap member 72.

As further shown in FIG. 9, a valve member 94 extends from the container-facing side 82 of valve member 68. As shown, valve member 68 and valve member 94 are of a unitary or one-piece construction. Valve member 94 comprises a head 96 resembling a diamond shape having opposed tapered regions 98, 100. A seal member 102 is secured in a recess 104 formed in dispenser body 58 and positioned or located between valve member 68 and valve member 94. Tapered region 100 forms a guide portion for providing guided insertion of valve member 94 through seal member 102 during assembly of regulator 60 to container 12.

As further shown in FIG. 9, the operation of regulator 60 is now discussed. Side 84 of valve member 68 is subjected to a force 64, which is the sum of two force components: the first force component is the product of the surface area of environment-facing side 84 multiplied by the pressure of ambient environment 19; the second force component is a force applied by spring 86. Side 82 of valve member 68 is subjected to a force 65 that is opposed to force 64. Force 65 is the product of a portion of the surface area of container-facing side 82 multiplied by the pressure of pressurized gas 106 from pressurized gas source 18.

In response to force 64 being greater than force 65, side 82 of valve member 68 remains in fluid tight contact with a corresponding surface of dispenser body 58, resulting in valve member 68 remaining in or being urged toward a closed position, and preventing a flow of pressurized gas 106 along pressurized gas flow path 108 from pressurized gas source 18. In response to force 64 being less than force 65, side 82 of valve member 68 is urged in a direction away from a facing surface of dispenser body 58, resulting in valve member 68 being urged toward or remaining in an open position. With valve member 68 in an open position, pressurized gas 106 from pressurized gas source 18 flows along a pressurized gas flow path 108 between side 82 and a corresponding facing surface of dispenser body 58, then through passageway 88, prior to flowing into container 12 via passageway 90.

In response to force 64 being sufficiently less than force 65, side 82 of valve member 68 is sufficiently urged in a direction away from a facing surface of dispenser body 58 such that tapered region 98 of valve member 94, which region 98 having or defining a seal portion, is similarly urged into a fluid tight contact with seal member 102, resulting in valve member 94 being urged toward a closed position, and preventing a flow of pressurized gas 106 from pressurized gas source 18 to container 12 as previously discussed.

As further shown in FIG. 9, the operation of pressure relief mechanism 62 is now discussed. That is, in response to regulator 60 malfunctioning, for example, failure of either of valve members 68, 94 to return to their respective closed positions, or other failure to selectively prevent pressurized gas flow path 108 from pressurized gas source 18 to container 12, at least a portion 92 of passageway 88 is configured to burst at a predetermined pressure less than a burst pressure of container 12, such as by portion 92 having a reduced thickness, scoring the surface of portion 92, or other suitable arrangement or construction. As a result of portion 92 of passageway 88 bursting, a vented pressurized gas flow path 110 prevents the container 12 from reaching its burst pressure.

Figure 12:
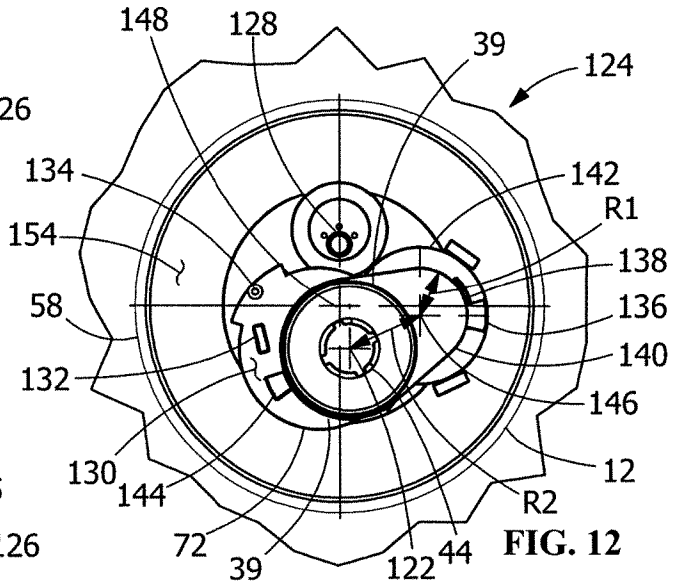
FIG. 12 is a further enlarged view taken along region 12 of the dispenser assembly of FIG. 11.
Figure 15:
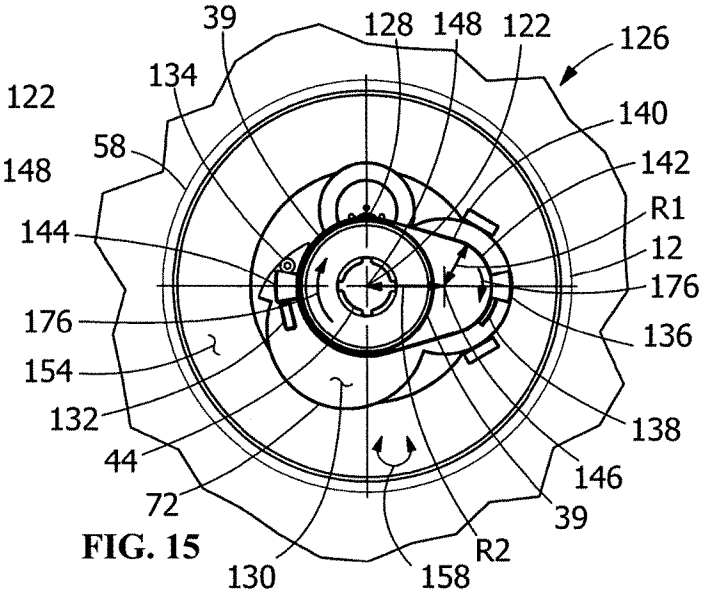
FIG. 15 is a further enlarged view taken along region 15 of the dispenser assembly of FIG. 14.
Figure 14:
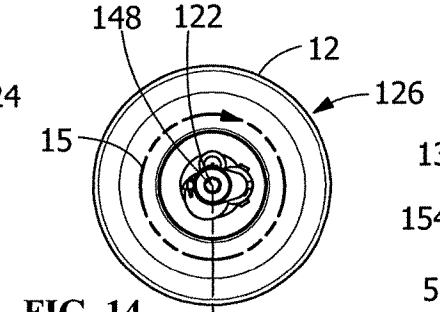
FIG. 14 is a plan view of the dispenser assembly of FIG. 13.
Figure 13:
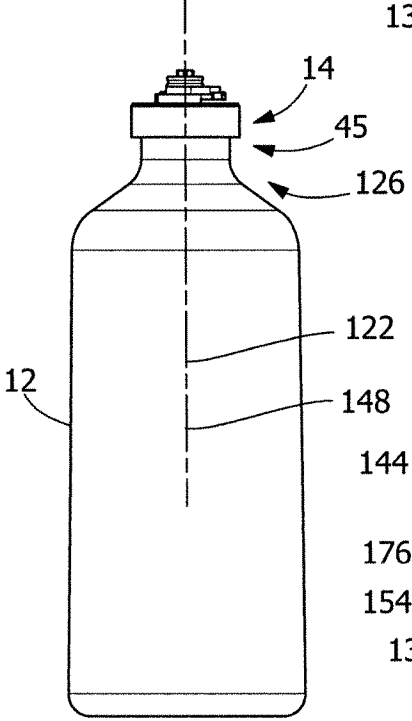
FIG. 13 is an elevation view of an exemplary dispenser assembly.
Figure 11:
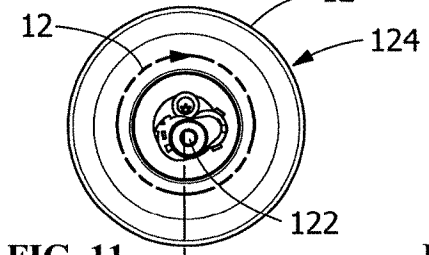
FIG. 11 is a plan view of the dispenser assembly of FIG. 10.
Figure 10:
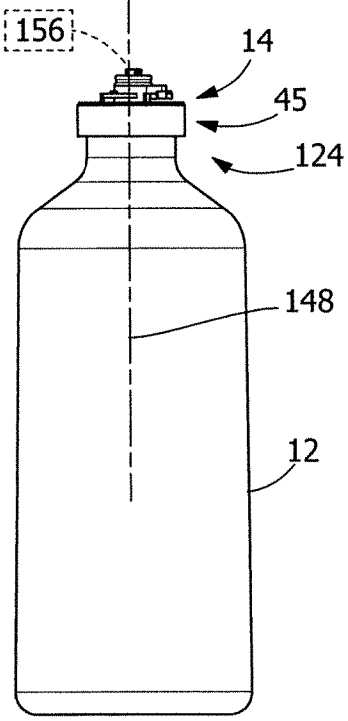
FIG. 10 is an elevation view of an exemplary dispenser assembly.
Figure 16:
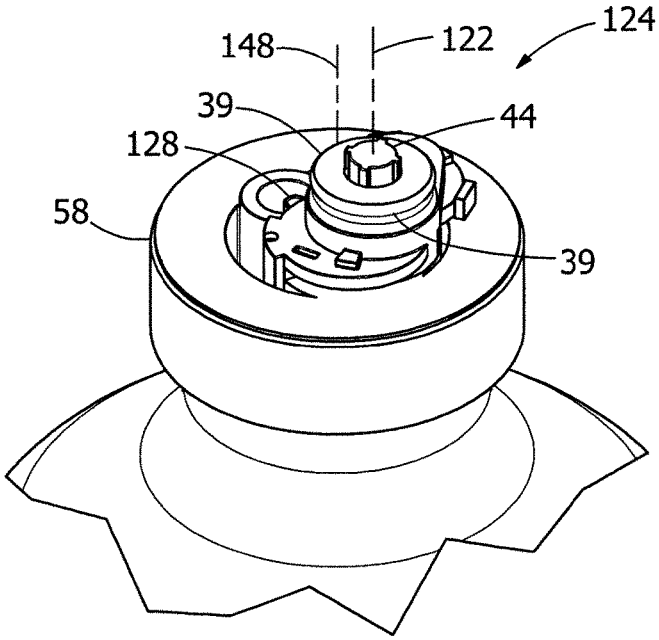
FIG. 16 is a partial upper perspective view of the dispenser assembly of FIG. 11.
Figure 17:
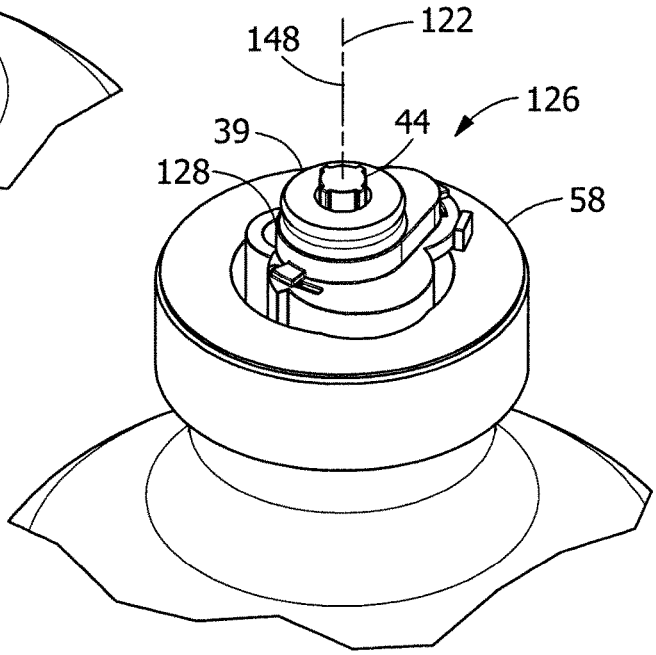
FIG. 17 is a partial upper perspective view of the dispenser assembly of FIG. 14.

As shown in FIGS. 6 and 10-17, dispense valve 45 of dispenser assembly 14 is now discussed. Dispense valve 45 comprises valve support member 38, cap member 39, and the valve member 44. Valve 44 includes an axis 122. As further shown in FIGS. 6 and 9, dispenser body 58 includes a surface 154 for slidably supporting cap member 72. Cap member 72 includes a surface 130 (FIG. 9) for slidably supporting valve support member 38. As shown in FIG. 12, a ramped protrusion 132, a post 134 and a retention feature 136 extend outwardly from surface 130 of cap member 72 in the direction away from surface 154 of dispenser body 58. As shown in FIG. 6, Valve support member 38 includes a tubular portion 150 that is inserted inside of a passageway 152 of dispenser body 58 that is in fluid communication with pressurized liquid 52 (FIG. 3) in container 12. Passageway 152 has an axis 146 for rotatably supporting valve support member 38 therearound.

As further shown in FIG. 6, valve support member 38 and cap member 39 surroundingly support valve member 44 therebetween. Valve member 44 includes an axis 122 that is separated from axis 146 by a radius R2. Cap member 39 includes a lobe 140 (FIGS. 6 and 12) having an interface edge 142 separated from axis 146 by a radius R1. A tab 138 (FIGS. 6 and 12) extends radially outward from interface edge 142 for engagement with retention feature 136 of cap member 72. A tab 144 extends radially outward from cap member 39 in a direction opposite tab 138. When dispenser valve 45 is moved from a position 124 (FIGS. 12 and 16) to a position 126 (FIGS. 15 and 17) tab 138 is moved between ramped protrusion 132 and post 134 to maintain dispenser valve 45 in position 126, as will be discussed in more detail below.

As shown in FIGS. 10-12 and 16, dispense valve 45 is shown in position 124, in which dispense valve 45 is in an exposed or open position. With dispense valve 45 in an open position 124, a pressurized gas inlet port 128 is accessible from exterior of dispense valve 45 and in fluid communication with an environment 19 (FIG. 4) surrounding dispenser assembly 14 and in fluid communication with an inner surface 118 (FIG. 5) of cavity 116 (FIG. 5) of vessel 15 (FIG. 5). As a result of dispense valve 45 being in or being moved or actuated to open position 124, pressurized gas from an external pressurized gas source 156 (FIG. 10) may be received via pressurized gas inlet port 128 that is in fluid communication with vessel 15. The vessel 15, upon receiving pressurized gas from the external pressurized gas source 156, becomes the pressurized gas source 18 for the dispenser.

As shown in FIGS. 13-15 and 17, dispense valve 45 is shown in position 126, with dispense valve 45 being in or being moved or actuated to a closed position 126 after receiving pressurized gas from external pressurized gas source 156. With dispense valve 45 in closed position 126, pressurized gas inlet port 128 is no longer accessible from exterior of dispense valve 45, such as by external pressurized gas source 156. Additionally, with dispense valve 45 in closed position 126, fluid communication is discontinued between pressurized gas source 18 (i.e., vessel 15 having received pressurized gas from external pressurized gas source 156) and environment 19 (FIG. 4).

As shown in FIGS. 6, 9 and 10-17, the operation for moving dispense valve 45 of dispenser assembly 14 from open position 124 to a closed position 126 is now discussed. With dispense valve 45 in open position 124, axis 122 is in a non-centered position relative to center axis 148 of dispenser assembly 14. That is, axis 122 and center axis 148 are not coincident with each other.

Pressurized gas from external pressurized gas source 156 is received via pressurized gas inlet port 128 into vessel 15, becoming pressurized gas source 18. Upon completion of pressurization of pressurized gas source 18, a force 158 (FIG. 15), and more specifically, a torsional force is applied to induce rotation about axis 146. As a result of force 158, cap member 39 and lobe 140 are collectively rotated about axis 146 in rotational movement direction 176 and are collectively slidably supported by surface 130, bringing tab 138 into engagement with retention feature 136, which engagement prevents cap member 39 and lobe 140 of dispense valve 45 from being inadvertently removed from dispenser assembly 14 as a result of pressurized gas in pressurized gas source 18. Concurrently or essentially concurrent with the engagement of tab 138 with retention feature 136, tab 144 slides over ramped protrusion 132 and is captured between ramped protrusion 132 and post 134 for retaining dispense valve 45 in closed position 126. As a result of captured tab 144 between ramped protrusion 132 and post 134, dispense valve 45 is retained in closed position 126. As a further result of dispense valve 45 being in closed position 126, fluid communication is discontinued between pressurized gas source 18 and the environment 19 surrounding the dispenser. With dispense valve 45 in closed position 126, axis 122 is in a centered position that is coincident with center axis 148 of dispenser assembly 14. Once dispense valve 45 is in closed position 126, dispensing mechanism 24 (FIG. 4) may be secured over the end of dispenser assembly 14 (FIG. 10) becoming dispenser 10 (FIG. 1).

Incorporation of the novel arrangement between respective open and closed positions 124, 126 of dispenser valve 45 of the present invention provides a more compact dispenser arrangement than previously possible, at the least reducing packaging size, resulting in reduced costs.

Furthermore, the novel regulator and pressure relief mechanism features of the present invention reduces the number of components as compared to conventional regulators and pressure relief mechanisms for effervescent liquid dispensers.

Figure 18:
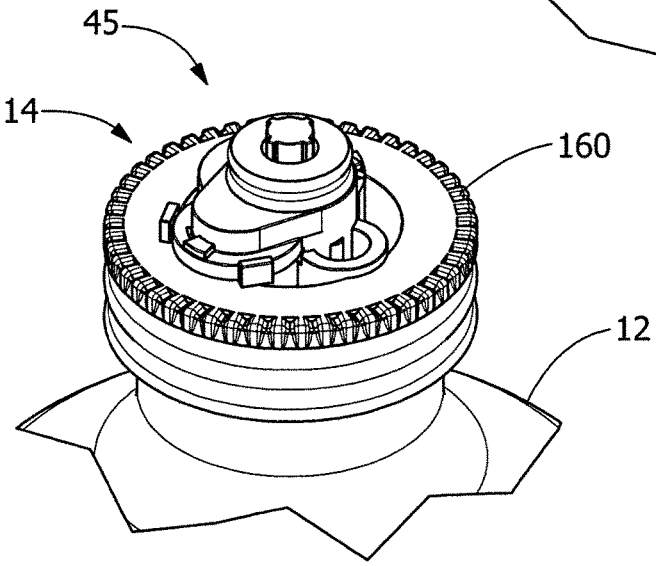
FIG. 18 is a partial upper perspective view of an exemplary dispenser assembly.

As shown in FIG. 18, an exemplary dispenser assembly 14 may include a peripheral metal member 160 secured over dispense valve 45. While any suitable method can be employed for securing member 160, member 160 can be crimped onto the container.

Figure 19:
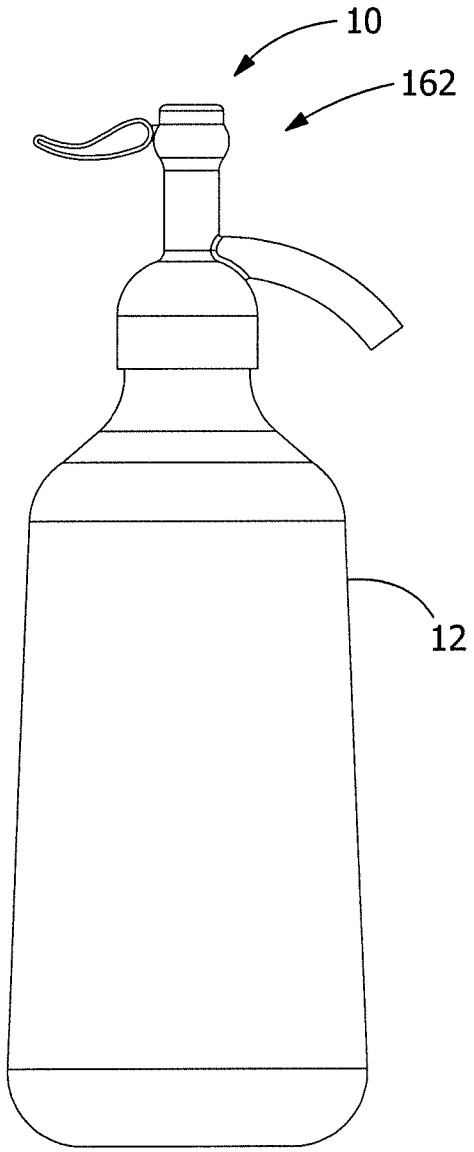
FIG. 19 is an elevation view of an exemplary dispenser.
Figure 20:
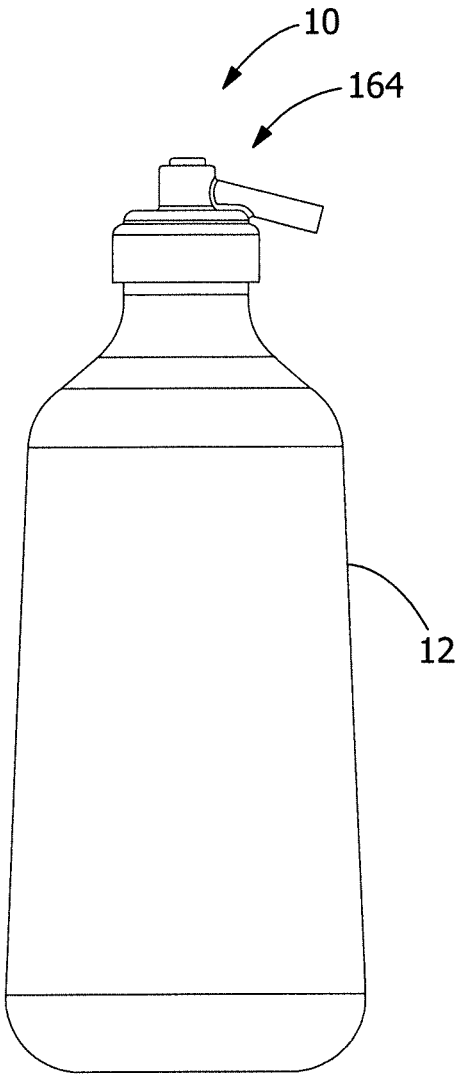
FIG. 20 is an elevation view of an exemplary dispenser.
Figure 21:
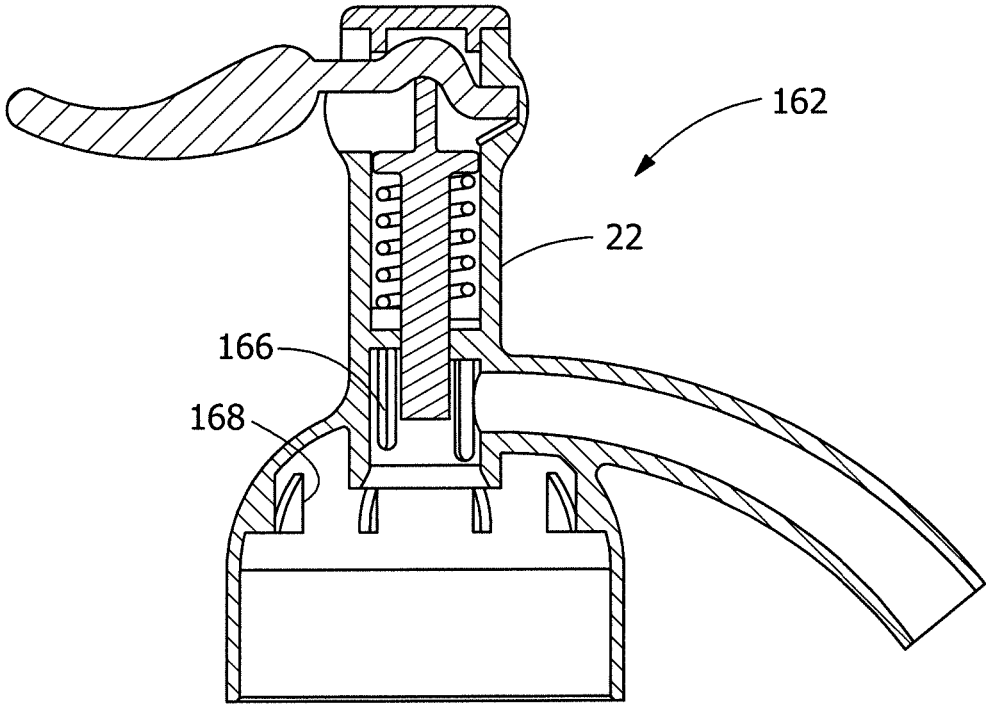
FIG. 21 is a cross-section of the dispensing mechanism of FIG. 19.
Figure 23:
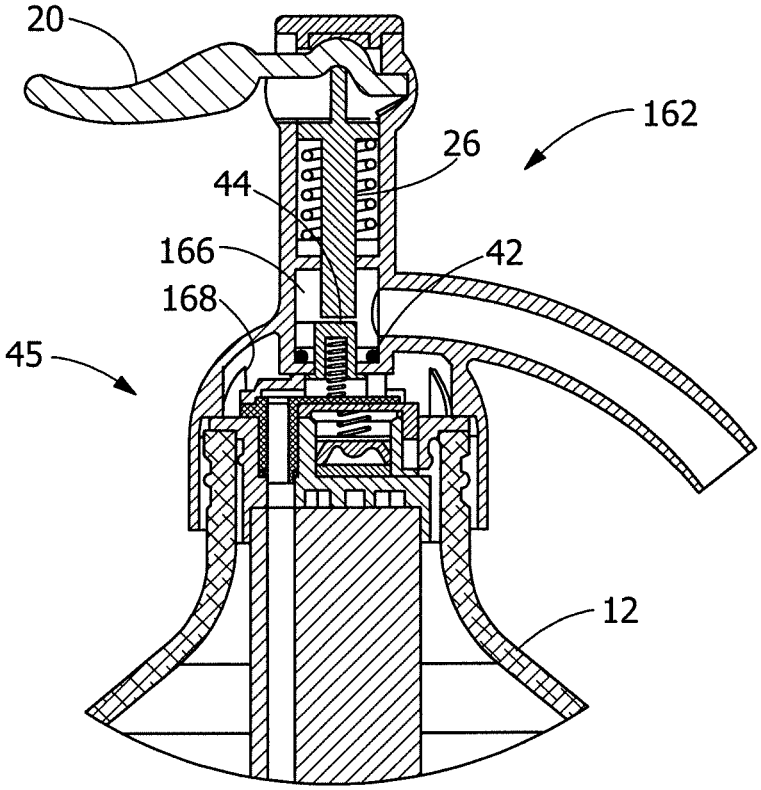
FIG. 23 is a cross-section of the dispenser of FIG. 19.

As shown in FIGS. 19 and 20, respective interchangeable dispensing mechanisms 162, 164 may be utilized to form the dispenser of the present invention. For example, as shown in FIG. 21, dispensing mechanism 162, which is similar to dispensing mechanism 24 (FIG. 4), includes dispenser body 22 having vertical rib features 166, 168 that vertically constrain O-ring 42 (FIG. 23) once assembled. O-ring 42 (FIG. 23) provides a fluid tight seal between dispensing mechanism 162 and dispense valve 45. As further shown in FIG. 23, in operation, in response to sufficient actuation of tap 20, fluid shaft 26 is similarly urged to actuate valve member 44, resulting in fluid being dispensed, as previously discussed.

Figure 22:
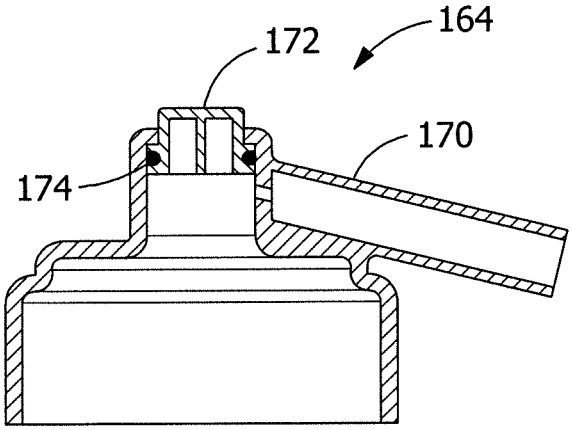
FIG. 22 is a cross-section of the dispensing mechanism of FIG. 20.
Figure 24:
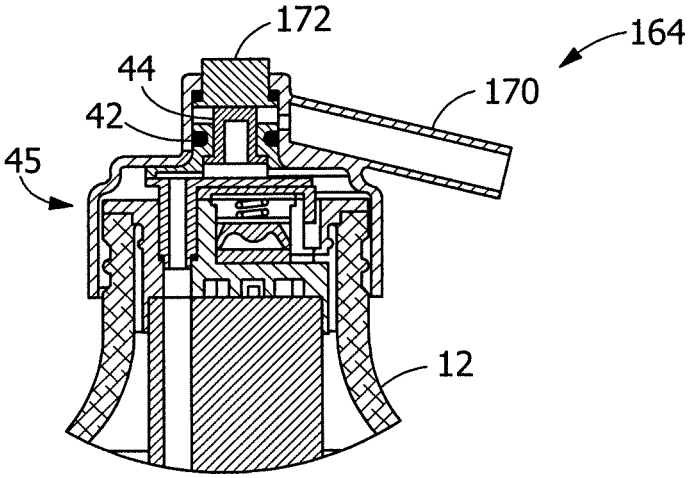
FIG. 24 is a cross-section of the dispenser of FIG. 20.
Figure 26:
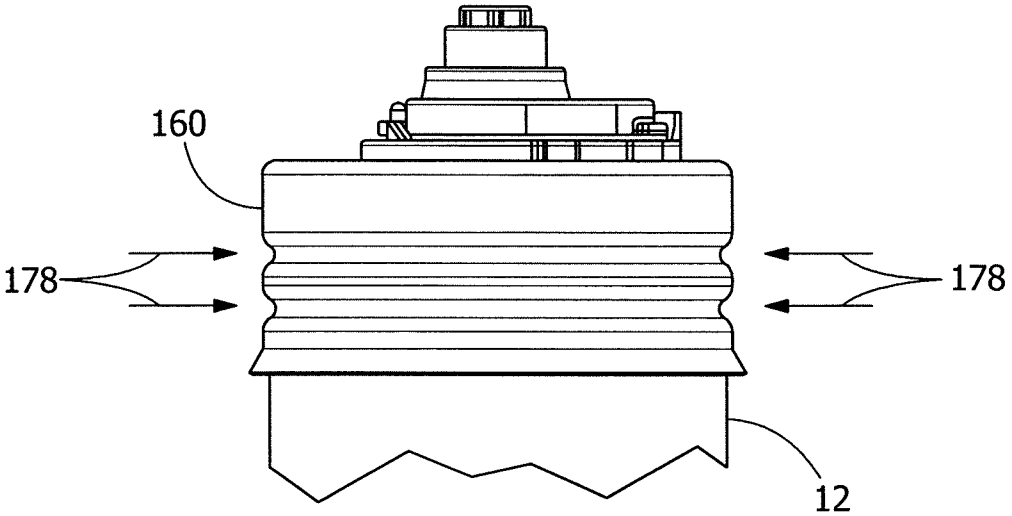
FIG. 26 is a cross-section of the dispenser taken from region 26 of FIG. 25.
Figure 25:
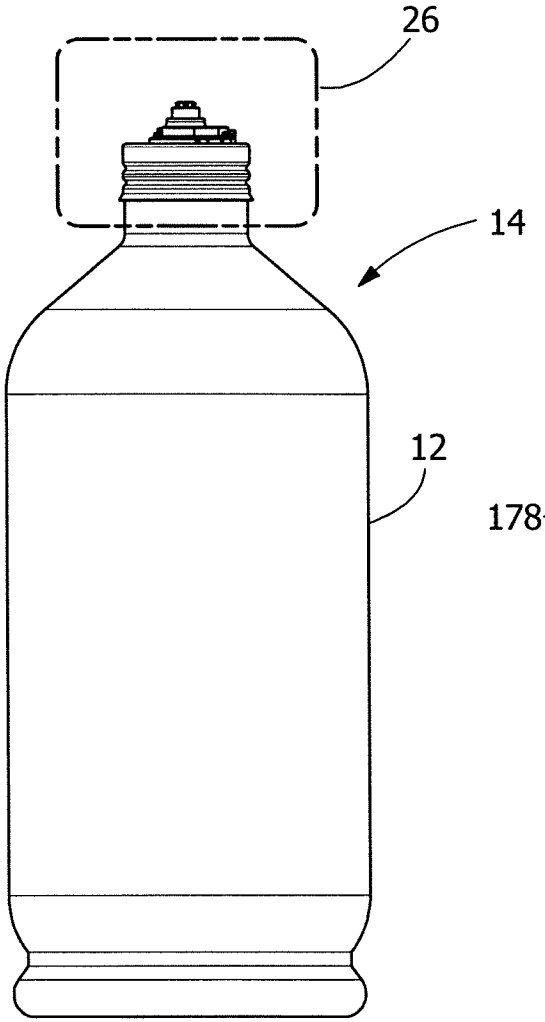
FIG. 25 is an elevation view of an exemplary partial dispenser.
Figure 28:
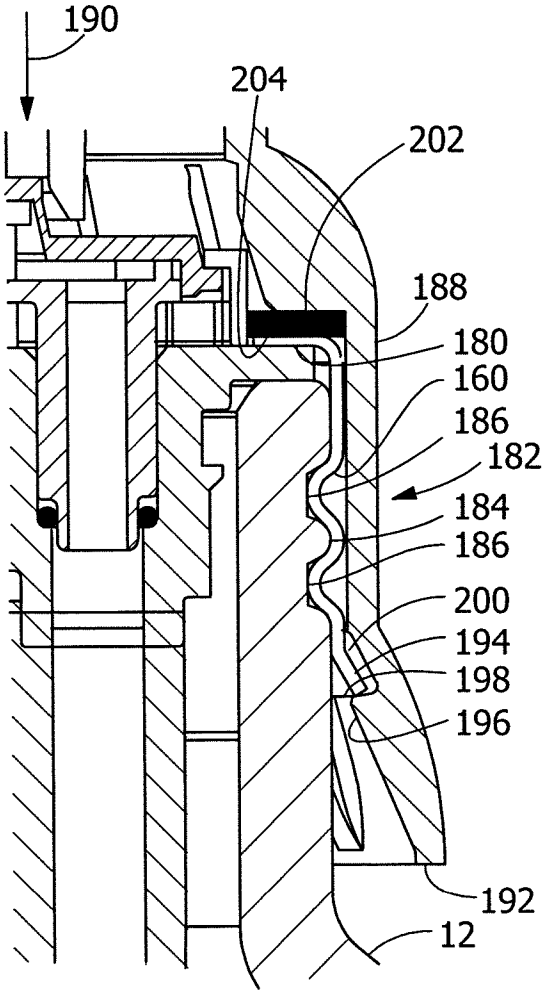
FIG. 28 is a further enlarged, partial cross-section taken from region 28 of the dispenser of FIG. 27.
Figure 27:
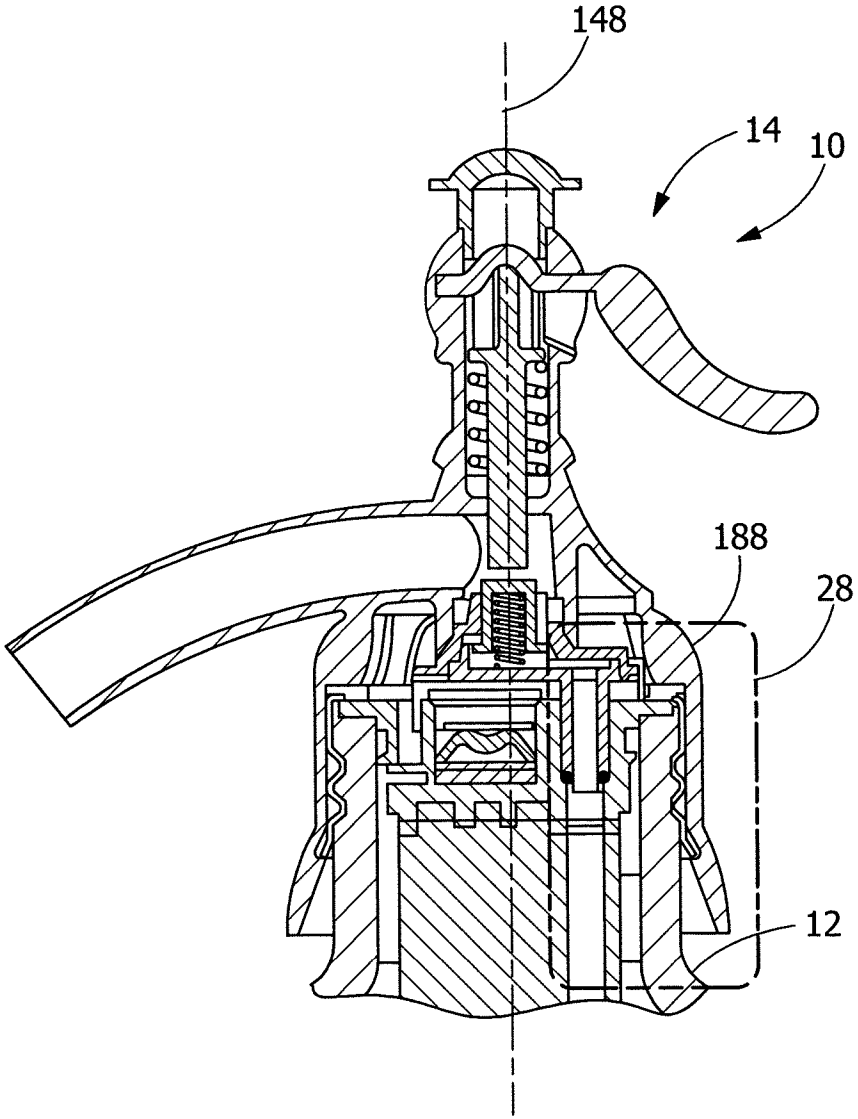
FIG. 27 is an elevation view of an exemplary dispenser.

Alternately, as shown in FIG. 20, dispensing mechanism 164 may be selectively utilized instead of dispensing mechanism 162 (FIG. 19). As shown in FIG. 22, dispensing mechanism 164 includes a dispenser body 170 further including a button or tap 172 that is slidably movable relative to dispenser body 170. An O-ring 174 maintains a fluid tight seal between tap 172 and dispenser body 170. As it is appreciated, dispensing mechanism 164 includes fewer components compared to dispensing mechanism 162, simplifying assembly and reducing costs of the dispenser. As shown in FIG. 24, in operation, in response to sufficient actuation of tap 172, the lower surface of tap 172 similarly urges actuation of valve member 44, resulting in fluid being dispensed, in a manner as previously discussed.

As shown in FIGS. 25-28, an exemplary construction of dispenser 10 having a two-step assembly process permanently securing dispenser assembly 14 to container 12 is now discussed. The first step includes permanently assembling or securing a compliant securing member 160 (FIG. 26) to the neck of container 12. Securing member 160 defines a generally cylindrical profile having an inwardly directed lip 180 that contacts the top of the neck of container 12, when securing member 160 is slid over the end of the neck of container 12. Securing member 160 is composed of a suitable compliant or ductile material, such as a metal. In response to an application of an inwardly directed or lateral compressive force 178 similar to that applied by a roller-type apparatus commonly used in the bottling industry to install roll-on-pilfer-proof (ROPP) style closures or cap members (not shown), securing member 160 is urged into a permanent, conformal contact with a non-threaded engagement member 182 (FIG. 28) of the neck of container 12. For example, as further shown in FIG. 28, engagement member 182 includes a rib or circumferential protrusion 184 positioned between a pair of recessed regions 186. In one embodiment, engagement member 182 includes surface discontinuities formed in the neck of container 12, such as one or more protrusions, recesses or a combination thereof. During assembly, rollers (not shown) apply lateral compressive force 178 to securing member 160, urging securing member 160 into conformal contact with engagement member 182, permanently affixing securing member 160 to container 12.

Returning to FIGS. 27-28, the second step of the two-step assembly process of dispenser 10 is now discussed. Dispenser 10 includes a dispenser body 188 that is permanently affixed or engaged over securing member 160 previously discussed. During assembly, dispenser body 188 is positioned vertically above or over and aligned with the neck of container 12, followed by application of a force 190 that is parallel to center axis 148 (FIG. 27) urging dispenser body 188 toward securing member 160. Force 190 may be applied by an apparatus similar to that utilized in the bottling industry to install corks in the bottles. As force 190 is applied, end 192 is further received over the end of the neck of container 12 until a flared end 194 of securing member 160 is brought into contact with an inwardly tapered portion 196 of the inside surface of dispenser body 188. In one embodiment, inwardly tapered portion 196 is comprised of a plurality of vertical ribs similar to ribs 168 (FIG. 23) positioned along the inside surface of dispenser body 188. In response to sufficient application of force 190, flared end 194, which has an undeflected diameter that is greater than the diameter corresponding to a ridge 198 of inwardly tapered portion 196 of the inside surface of dispenser body 188, results in flared end 194 being deflected radially inward sufficient for flared end 194 to slide past ridge 198, after which flared end 194 is received in an annular recessed region 200. Simultaneously, a compliant member 202 positioned between shoulder 204 and lip 180 of securing member 160 is compressed therebetween. Upon removal of force 190, a retention force exerted by compliant material 202 urges flared end 194 into contact with a facing surface 206 of recessed region 200. Compliant member 202 is sized such that the retention force exerted by compliant material 202 is sufficient to ensure a fluid tight seal between dispenser body 188 and lip 180 of securing member 160, irrespective of component dimensional tolerances.

It is to be understood, that any number of different interchangeable configurations of dispensing mechanisms may optionally be used with the dispenser of the present invention, providing a user with an endless choice of perspective aesthetically pleasing constructions.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An effervescent liquid dispenser comprising:

a container containing a liquid to be dispensed receiving pressurized gas from a pressurized gas source, becoming a pressurized liquid, the pressurized liquid becoming an effervescent liquid upon being dispensed from the container; and a dispense valve that is positionable in a first position for permitting pressurized gas to be received in a vessel to become the pressurized gas source, the dispense valve selectably movable between the first position and the second position, the dispense valve being secured to the container in the second position in response to the vessel receiving pressurized gas, the vessel becoming the pressurized gas source for the dispenser;

wherein the dispense valve further comprises a cap which is rotated about an axis to engage a retention feature that prevents the cap from being removed from the dispenser.

2. The dispenser of claim 1 further comprising a regulator having a first valve member in selective fluid communication with at least one of the pressurized gas source and an inner surface of the container on a first side of the first valve member, the first valve member having an opposed second side;

wherein in response to a first force applied to the first side of the first valve member exceeding a second force applied to the second side of the first valve member, the first valve member is actuated to an open position for discharging pressurized gas from the pressurized gas source into the container;

wherein in response to the first force applied to the first side of the first valve member being less than the second force applied to the second side of the first valve member, the first valve member is actuated to a first closed position for preventing pressurized gas discharge from the pressurized gas source into the container.

3. The dispenser of claim 2 wherein the first valve member extending from the first side of the first valve member to a second valve member, the second valve member including a head having a seal portion;

wherein in response to the first force applied to the first side of the first valve member sufficiently exceeding the second force applied to the second side of the first valve member, the first valve member and the second valve member being actuated to a second closed position, the seal portion of the second valve member forming a fluid tight seal with a seal member positioned between the first valve member and the second valve member for preventing pressurized gas discharge from the pressurized gas source into the container.

4. The dispenser of claim 3, wherein the second valve member resembles a diamond shape including opposed tapered regions, the seal portion of the second valve member including one tapered region facing the first valve member;

wherein a remaining tapered region facing away from the first valve member, the remaining tapered region forming a guide portion for providing guided insertion of the second valve member through the seal member during assembly of the pressure relief valve to the container.

5. The dispenser of claim 4, wherein the first valve member and the second valve member are of a unitary or one-piece construction.

6. The dispenser of claim 2, further comprising a pressure relief mechanism including a passageway in fluid communication with the pressurized gas source and the container when the first valve member is in the first open position;

wherein at least a portion of the passageway is in fluid communication with the pressurized gas source and the container on one side of the at least a portion of the passageway, and in fluid communication with an environment surrounding the dispenser on the other side of the at least a portion of the passageway;

wherein the at least a portion of the passageway is configured to burst at a predetermined pressure less than a burst pressure of the container.

7. A container comprising:

an effervescent liquid and an effervescent liquid dispenser comprising a dispense valve that is positionable in a first position for permitting pressurized gas to be received in a vessel to become the pressurized gas source, the dispense valve selectably movable between the first position and the second position, the dispense valve being secured to the container in the second position in response to the vessel receiving pressurized gas, the vessel becoming the pressurized gas source for the dispenser;

wherein the liquid dispenser is permanently affixed to the container and the container is non-refillable; and wherein the dispense valve further comprises a cap which is rotated about an axis to engage a retention feature that prevents the cap from being removed from the dispenser.

8. The container of claim 7 wherein the container complies with 27 C.F.R. 5.46 (2017).

9. The container of claim 7 wherein the container conforms with 49 C.F.R. 173.306 (2017).

10. The container of claim 7 wherein the liquid dispenser is permanently affixed by a snap fit connection.

11. The container of claim 7 wherein the liquid dispenser is permanently affixed by a crimp fit.

12. The container of claim 7 wherein the vessel is located within the container.

13. The container of claim 12 wherein the vessel includes a proximal end extending from a dispenser assembly to a distal end.

14. The container of claim 13 wherein the vessel comprises a cavity containing pressurized gas and an inner surface, the vessel further incorporating a passageway that is axially aligned with and separate from the cavity, the passageway extending from the proximal end to the distal end;

wherein a shaft extends through the dispenser assembly and movement of the shaft permits pressurized gas from the vessel to flow, forcing the effervescent liquid into the passageway that in turn permits the effervescent liquid to pass through the dispenser and be dispensed from the container.

15. The container of claim 14 wherein the cavity includes at least one rib spanning opposed portions of the inner surface.

16. The container of claim 14 further comprising a tap that is located externally to the dispenser and container and wherein movement of the shaft is caused by rotational movement of a tap.

17. The container of claim 16 further comprising a spout connected to the dispenser and wherein the effervescent liquid is dispensed from the container from the spout.

18. The container of claim 7 wherein the vessel is an extrusion.

19. The container of claim 7 wherein the effervescent liquid comprises a carbonated alcoholic beverage.

20. The container of claim 7, wherein the container comprises a non-threaded engagement member;

a compliant securing member deformably and permanently affixed over the engagement member in response to application of a lateral compressive force to the securing member;

a dispenser body positioned over the securing member, the dispenser body having an engagement feature for permanently engaging a corresponding engagement feature of the securing member in response to application of a sufficient mutually aligned axial force of the dispenser body toward the securing member.

21. An effervescent liquid dispenser for a carbonated beverage comprising:

a container containing liquid to be dispensed receiving pressurized gas from a pressurized gas source, becoming a pressurized liquid, the pressurized liquid becoming an effervescent liquid upon being dispensed from the container; and a dispense valve that is positionable in a first position for permitting pressurized gas to be received in a vessel to become the pressurized gas source, the dispense valve selectably movable between the first position and the second position, the dispense valve being secured to the container in the second position in response to the vessel receiving pressurized gas, the vessel becoming the pressurized gas source for the dispenser;

wherein the container complies with 27 C.F.R. 5.46 (2017) and conforms with 49 C.F.R. 173.306 (2017); and wherein the dispense valve further comprises a cap which is rotated about an axis to engage a retention feature that prevents the cap from being removed from the dispenser.

* * * * *